US005375362A

United States Patent [19]

McGarry et al.

[11] Patent Number: 5,375,362

[45] Date of Patent: Dec. 27, 1994

[54] LASER SIGHTED FIREARM

[75] Inventors: James McGarry, Prescott; Larry E. Moore, Cottonwood, both of Ariz.

[73] Assignee: Sturm, Ruger & Company, Inc., Southport, Conn.

[21] Appl. No.: 133,536

[22] Filed: Oct. 7, 1993

[51] Int. Cl.[5] ..... F41G 1/35

[52] U.S. Cl. ..... 42/103; 362/110

[58] Field of Search ..... 42/103; 362/110, 113, 362/114; 33/241

[56] References Cited

U.S. PATENT DOCUMENTS

| | | | |
|---|---|---|---|
| 4,048,489 | 9/1977 | Giannetti | 42/103 |
| 4,220,983 | 9/1980 | Schroeder | 362/114 |
| 4,764,011 | 8/1988 | Goldstein | 33/241 |
| 5,237,773 | 8/1993 | Claridge | 42/103 |

FOREIGN PATENT DOCUMENTS

| | | | |
|---|---|---|---|
| 1286707 | 1/1962 | France | 42/103 |
| 654655 | 2/1986 | Switzerland | 362/110 |

*Primary Examiner*—Stephen M. Johnson
*Attorney, Agent, or Firm*—Pennie & Edmonds

[57] ABSTRACT

A firearm having a laser beam capacity for aiding in sighting positioned within the firearm for adjustment therein and having an on-off switch operated by the firearm operator's trigger finger of the trigger finger hand is in position on the firearm grip. The switch can be assembled for operation by finger pressure from a selected side of the firearm.

6 Claims, 3 Drawing Sheets

LASER SIGHTED FIREARM

BACKGROUND OF THE INVENTION

Lasers have been utilized for aiming firearms by mounting a laser unit on the firearm sights or within firearms (U.S. Pat. No. 5,237,773). Many of these laser units have operating switches located upon the laser unit, or are located upon the grip or other areas of the firearm and are connected to the laser unit by wires. None, however, combine an integrally frame-mounted laser unit with a reversible cross-mounted push button operating switch located in the frame immediately in front of the trigger operating area, for both security and ease of operation.

SUMMARY OF THE INVENTION

Broadly, the present invention comprises a firearm having within its frame a laser beam generator in a longitudinal cavity below the barrel, a cross mounted push button switch capable of right or left hand ambidextrous use when selectively installed. This switch is operable by one of the firearm operator's index fingers as placed on the firearm. The direction of the laser beam is adjustable by the operator.

It is a feature that the laser can be turned on by the firearm operator's trigger finger when the trigger finger hand is in position for firing. The laser is turned off using any finger or hand.

DESCRIPTION OF THE PREFERRED EMBODIMENT

Figure 1:
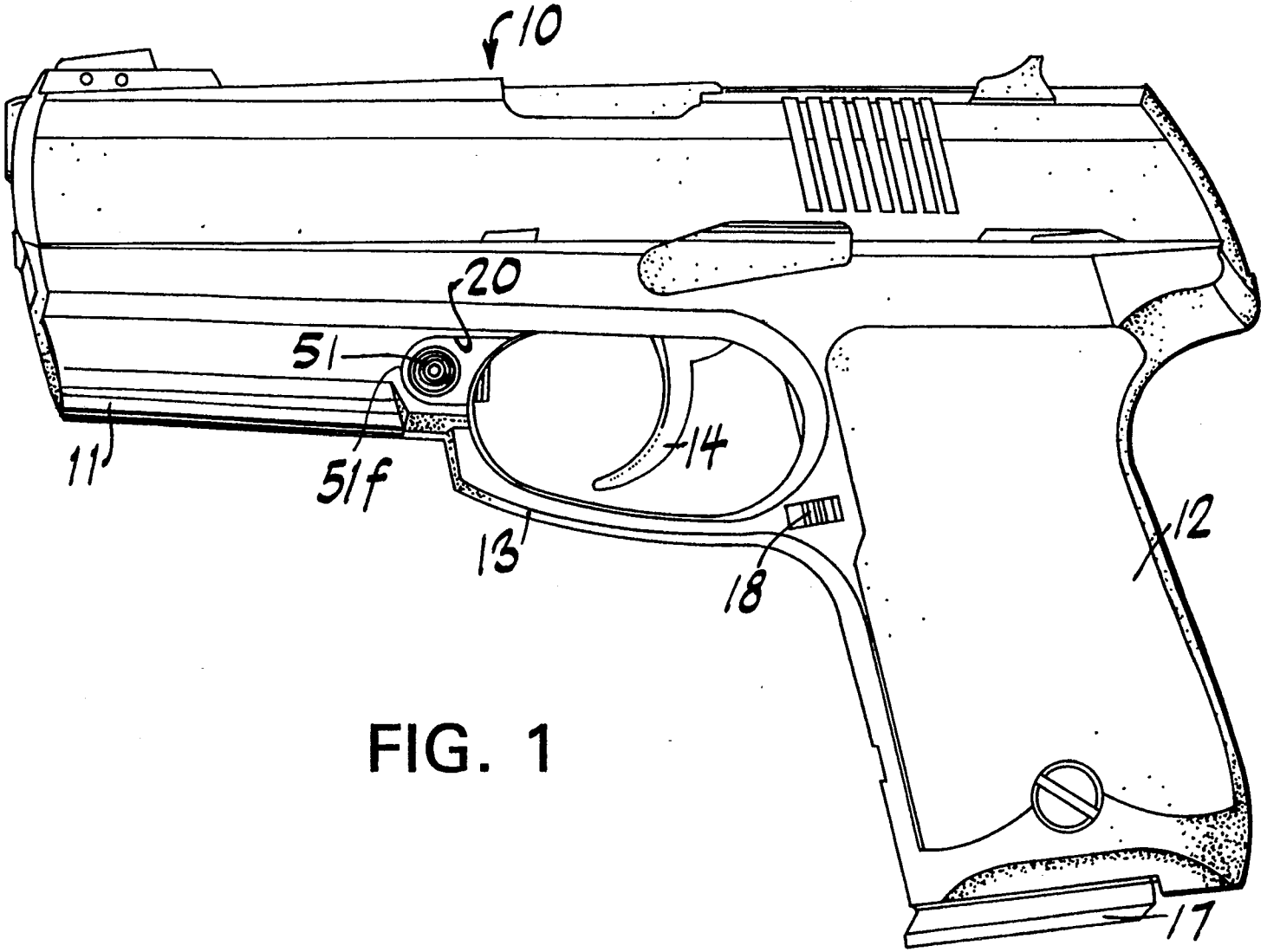
FIG. 1 is a left side elevational view of the pistol of the present invention.
Figure 2:
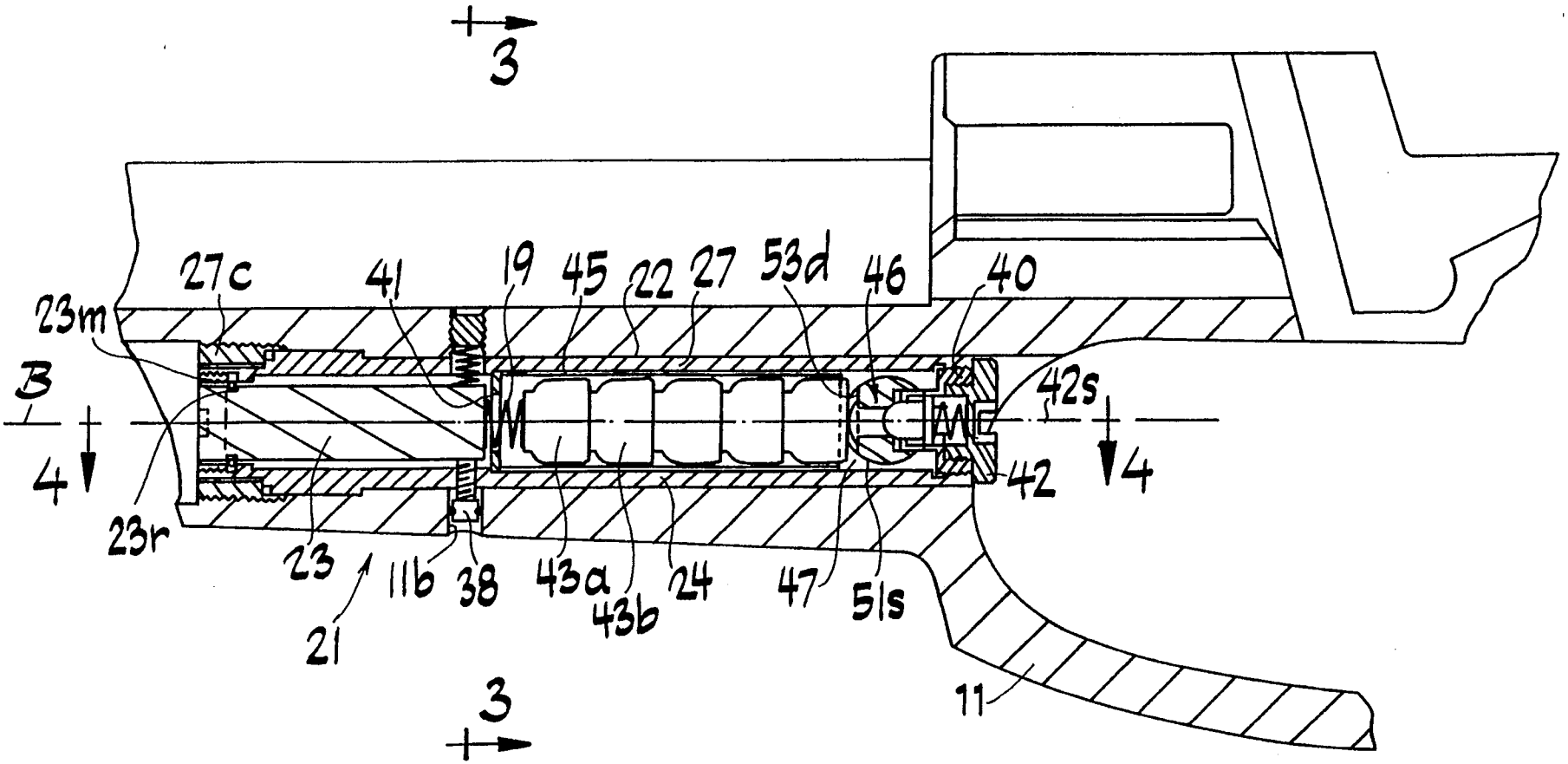
FIG. 2 is a partially enlarged sectional view of the laser sighting arrangement of the present invention.

In FIGS. 1 and 2, pistol 10 includes frame 11, handle 12, trigger guard 13 and trigger 14. Also shown is magazine 17, magazine release catch 18 and laser sighting activation button 51 in recess 20. There is a similar recess on the opposite side (not shown).

Turning in particular to FIG. 2, laser sight arrangement 21 is shown mounted in cylindrical frame cavity 22. Sight arrangement 21 includes forward laser unit 23 and rear energy supply unit 24 in housing 27 within frame cavity 22. Housing 27 is held in cavity 22 by threaded forward ring 27*c*. Mounted within housing 27 is forward laser unit mount piece 23*m* having resilient mounting ring 23*r* which engages the forward portion of laser unit 23 permitting such portion to move slightly as the rearward portion of unit 23 is adjusted to various positions. Laser unit 23 generates a laser beam (B) for aiding in sighting pistol 10.

Figure 3:
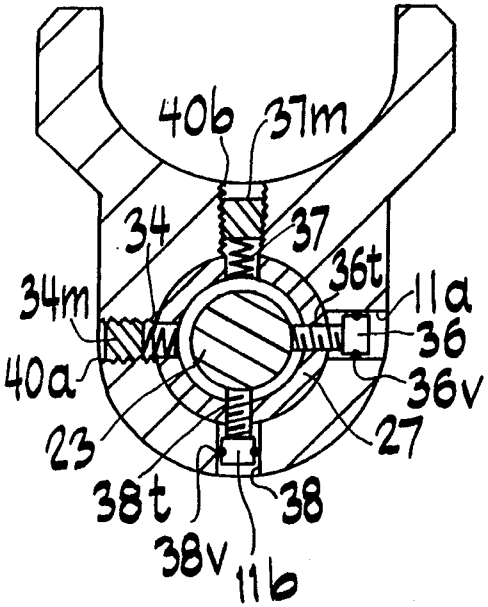
FIG. 3 is a sectional view along line 3—3 of FIG. 2.

The rearward portion of unit 23 is mounted for side-to-side or windage adjustment using threaded adjuster 36 urging unit 23 against spring 34 and for up-and-down or elevation adjustment using threaded adjuster 38 urging moving unit 23 with respect to spring 37 (see FIG. 3). Springs 34 and 37 are adjusted in tension at the factory by turning spring mounts 34*m*, 37*m* in threaded holes 40*a*, 40*b*. Threaded laser adjusters 36, 38 turn in housing threads 36*t*, 38*t* located in housing 27 and are adjusted by the pistol operator. Adjusters 36 and 38 are located in frame recess openings 11*a*, 11*b* and include tool or key engagement means (not shown) for adjustment. Vibration rings 36*v*, 38*v* resist turning of the adjuster 36, 38 during pistol use.

Turning again to FIG. 2, energy unit 24 in the rearward portion of housing 27 includes internal spacer ring 41, end cap unit 42 including plunger housing 40 and a series of batteries 43*a*–*e* in insulation sleeve 45 and energizer switch unit 46. Battery spring 19 urges batteries toward cap unit 42. Unit 46 is housed in cross housing recess 47 (FIG. 4) which extends all the way through pistol 10 from recess 20 to the opposite recess.

Figure 4:
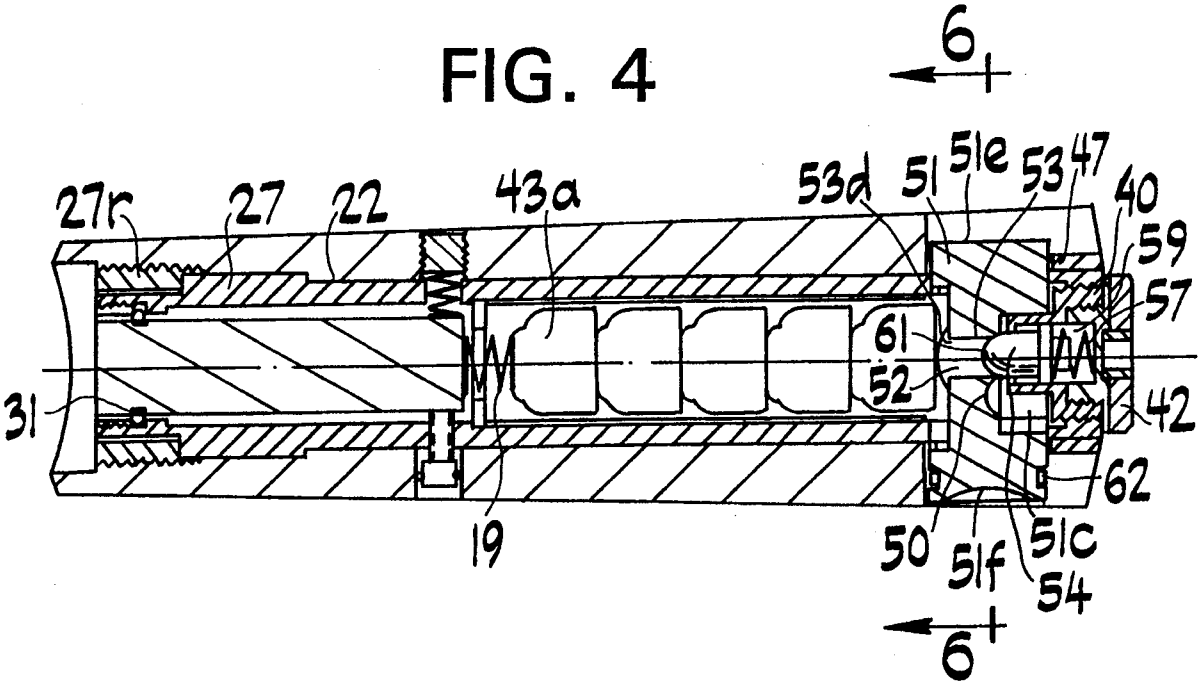
FIG. 4 is a sectional view along line 4—4 of FIG. 2.
Figure 6:
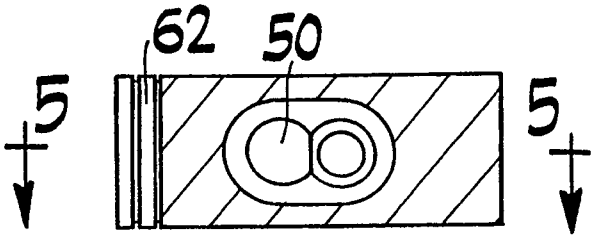
FIG. 6 is a sectional view along line 6—6 of FIG. 4.
Figure 5:
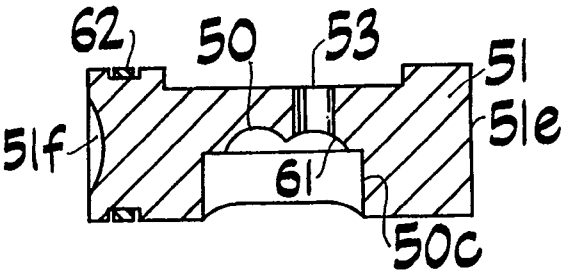
FIG. 5 is a sectional view along line 5—5 of FIG. 6.

In FIG. 4, switch unit 46 includes slidable body 51 having electrical contact rivet 52 installed in recess 53 of body 51. Rivet 52 is shown in sliding engagement with end battery 43*e*. Switch contact plunger 54 is mounted in end cap 42 for reciprocal axial movement under the influence of spring 57. As body 51 is transversely urged, plunger 54 snaps into rivet concavity 61 for energizing unit 23 or into adjacent neutral concavity 50 for de-energizing unit 23. Body cutout portion 51*c* provides space for and limits plunger 54 movement. Plunger housing 40 also limits body 51 movement. Housing rivet recess 53*d* engages battery 43*e* to limit transverse movement of body housing 51 until sufficient force is applied to battery 43*e* to urge it left against spring 19. Spring 57 is mounted in cap unit recess 59 of cap unit 42. Also shown is red indicator band 62.

When the laser switch is "on", a circuit is completed which includes electrically conductive rivet 52, plunger 54, plunger cap mount 42, housing 27, laser adjusters 36, 38, laser unit 23, battery spring, to batteries, back to rivet 52 completing the circuit.

Switch unit 46, as installed in FIG. 4, serves right-hand operators or shooters since application of finger pressure against the right end 51*e* of housing 51 is required to be applied from the right side of pistol 10 (FIG. 1) to operate switch unit 46.

Operation of pistol 10 by a right handed shooter is as follows:

1. The operator grips pistol 10 in his right hand as if to fire pistol 10;
2. Instead of pressing the right index finger against trigger 14, the finger is positioned over the right side of switch 46 to push it to the left to energize the laser unit 23;
3. This right index finger is then brought back to trigger 14 to fire pistol 10;
4. To turn the laser off preferably a finger from the left hand is used to push the left side of switch 46 to the "off" position.

Law enforcement personnel are trained to draw a pistol from a holster by gasping the pistol handle or grip with the right hand, while at the same time extending the right index finger forward and outside the trigger guard as the pistol is pulled from the holster. Switch 46, with its body 51, is positioned at the point that the right index finger of such personnel becomes located following such pistol drawing from the holster and hand extension.

To accommodate left-hand shooters, cap 42 including plunger housing 40 is removed allowing body 51 to be removed and reinserted in cross housing 47 with housing end 51*e* on the opposite side of pistol 10. To accomplish such reversal of body 51, coin operable slot 51*f* is used to rotate body 51 90 degrees causing housing cylindrical surface 51*s* to engage battery 43*e* to move battery 43*e* to the left (FIG. 2) against spring 19 to permit cavity 53*d* to clear battery 43*e* thus permitting body 51 to be removed. Body 51 is turned end for end, replaced and then rotated 90 degrees.

To replace batteries 43, end cap unit 42 is removed using coin operated cap slot 42*s* which unit includes plunger housing 40. Housing 51 is then removed to allow batteries 43 to slide out of sleeve 45 when pistol 10 is tipped.

we claim:

1. In a sighting system for a firearm having a frame and a barrel having a longitudinal axis comprising a) a longitudinal laser cavity in such frame having a longitudinal axis generally parallel to the longitudinal axis of the barrel;

b) a laser beam unit in the longitudinal cavity including i) a laser beam portion; and ii) an energy supply portion;

c) a cross cavity in the frame adjacent the energy supply portion;

d) a laser beam switch unit in the cross cavity for operation therein from a position to energize the laser beam portion to a position to de-energize the laser portion; said switch unit in turn comprising i) a translatable body movable in the cross cavity;

ii) conductive means mounted in the body for contacting the energy supply portion; and iii) plunger means mounted adjacent the translatable body for contact with the conductive means when the body is in one translated position and for non-conductive contact when the body is in another translated position,

2. The sighting system of claim 1 having in addition end cap means in which the plunger means is mounted for movement along an axis parallel to such longitudinal axis.

3. The sighting system of claim 1 in which the laser beam generating portion is spaced from the cross cavity and having in addition adjustment means adjustable by the operator of the firearm,

4. The sighting system of claim 1 having in addition a frame cavity in the frame and in which the laser cavity is defined by a housing sleeve installed in the frame cavity.

5. The sighting system of claim 3 in which the translatable body is capable of being reversed to accommodate either right-handed or left-handed pistol operators.

6. The sighting system of claim 3 in which the adjustment means comprises a) spring means urging the laser beam generating portion in one direction; and b) adjusters urging the laser beam generating portion in other directions as such adjusters are adjusted.

* * * * *